US005937731A

United States Patent [19]

Kazahaya

[11] Patent Number: 5,937,731

[45] Date of Patent: Aug. 17, 1999

[54] VARIABLE CAPACITY SWASH PLATE COMPRESSOR

[75] Inventor: Yukio Kazahaya, Kawagoe, Japan

[73] Assignee: Zexel Corporation, Tokyo, Japan

[21] Appl. No.: 09/001,185

[22] Filed: Dec. 30, 1997

[30] Foreign Application Priority Data

Jan. 10, 1997 [JP] Japan ..... 9-014666

[51] Int. Cl.[6] ..... F01B 13/04; F04B 25/04

[52] U.S. Cl. ..... 92/12.2; 92/57; 92/71; 417/269

[58] Field of Search ..... 92/12.2, 57, 71; 417/269

[56] References Cited

U.S. PATENT DOCUMENTS

| | | | |
|---|---|---|---|
| 5,533,871 | 7/1996 | Takenaka et al. | 417/269 |
| 5,573,379 | 11/1996 | Kimura et al. | 417/269 X |
| 5,603,611 | 2/1997 | Tarutani et al. | 417/269 |
| 5,784,950 | 7/1998 | Kayukawa et al. | 417/269 X |

*Primary Examiner*—Hoang Nguyen

*Attorney, Agent, or Firm*—Frishauf, Holtz, Goodman, Langer & Chick, P.C.

[57] ABSTRACT

A swash plate of a variable capacity swash plate compressor has a front-side sliding surface and a rear-side sliding surface. Pairs of substantially hemispherical shoes each perform relative rotation on the front-side and rear-side sliding surfaces of the swash plate, respectively, with respect to the circumference of the swash plate as the drive shaft rotates. A plurality of pistons each have one end thereof formed therein with a pair of concave support portions for each slidably supporting the shoe. At least one of the front-side and rear-slde sliding surfaces of the swash plate has a mounting recess formed at an outer peripheral portion thereof, the outer peripheral portion receiving no load which acts on the at least one of the front-side rear-side sliding surfaces of the swash plate. The mounting recess is used for assembling the each pair of the pairs of shoes with the swash plate and the pair of concave support portions at the one end of a corresponding one of the pistons. The mounting recess has a recess for placing one shoe of the each pair of the pairs of shoes therein and a guide face for guiding the one shoe onto a corresponding one of the at least one of the front-side and the rear-side sliding surfaces of the swash plate.

8 Claims, 6 Drawing Sheets

VARIABLE CAPACITY SWASH PLATE COMPRESSOR

BACKGROUND OF THE INVENTION

1. Field of the Invention

This invention relates to a variable capacity swash plate compressor in which the amount of stroke of each piston changes according to an inclination of the swash plate whereby the delivery quantity of the compressor is changed.

2. Description of the Prior Art

A conventional variable capacity swash plate compressor includes a thrust flange rigidly fitted on a drive shaft, for rotation in unison with the drive shaft, a swash plate which is tiltably and rotatably mounted on the drive shaft and connected to the thrust flange via a linkage, for rotation in unison with the thrust flange, and a plurality of pistons each of which is connected to the swash plate via a pair of hemispherical shoes performing relative rotation on sliding surfaces of the swash plate with respect to the circumference of the swash plate, and reciprocates within a cylinder bore as the swash plate rotates.

The pair of shoes are arranged on an outer peripheral portion of the swash plate in a manner sandwiching the same, in a state slidably held at one end portion of the piston.

The swash plate is received in a crankcase. The inclination of the swash plate varies with pressure within the crankcase, whereby the amount of stroke of the piston is changed.

Torque of an engine installed on an automotive vehicle is transmitted to the drive shaft. Torque of the drive shaft Is transmitted from the thrust flange to the swash plate via the linkage to cause rotation of the swash plate.

As the swash plate rotates, the pair of shoes perform relative rotation on the front-side and rear-side sliding surfaces of the swash plate, respectively, with respect to the circumference of the swash plate, whereby torque transmitted from the swash plate to converted into reciprocating motion of the piston. As the piston reciprocates within the cylinder bore, the volume of a compression chamber within the cylinder bore changes, whereby suction, compression and delivery of refrigerant gas are carried out sequentially, and high-pressure refrigerant gas is discharged in an amount or volume corresponding to an inclination of the swash plate.

In the conventional compressor, however, since the hemispherical shoes are constructed to form an imaginary sphere with the outer peripheral portion of the swash plate interposed therebetween, each of the shoes is required to be thin. Therefore, the shoes are not easily held at the end of the piston, which makes it difficult to assemble the shoes and the piston with the swash plate whether manually or automatically.

Further, if a compressor has as many as five to seven pistons, space between adjacent ones of the pistons of the compressor becomes so small that it is difficult to even put hands therebetween, which also makes it difficult to assemble the shoes and the piston with the swash plate by manual work.

SUMMARY OF THE INVENTION

It is an object of the invention to provide a variable capacity swash plate compressor having a construction which makes it easy to assemble shoes and a piston with a swash plate manually, and makes it also possible to facilitate automatic assembly of the shoes and the piston with the swash plate.

To attain the above object, the present invention provides a variable capacity swash plate compressor including a drive shaft having one end, a rotating member rigidly fitted on the drive shaft, for rotation in unison with the drive shaft, a swash plate which is tiltably and rotatably mounted on the drive shaft, the swash plate having a front-side sliding surface and a rear-side sliding surface, a linkage connecting the rotating member and the swash plate in a manner such that the swash plate rotates in unison with the rotating member as the rotating member rotates, a crankcase through which the drive shaft extends and in which the swash plate is received, pairs of shoes each having a substantially hemispherical shape, each pair of the pairs of shoes performing relative rotation on the front-side sliding surface and the rear-side sliding surface of the swash plate, respectively, with respect to a circumference of the swash plate as the swash plate rotates, a cylinder formed therethrough with a plurality of cylinder bores and a central hole, the one end of the drive shaft being rotatably arranged in the central hole, and a plurality of pistons each connected to the swash plate via a corresponding pair of the pairs of shoes and reciprocating within a corresponding one of the cylinder bores as the swash plate rotates, the each pair of the pairs of shoes being arranged on the front-side sliding surface and the rear-side sliding surface, respectively, in a manner sandwiching the swash plate, each of the pistons having one end thereof formed therein with a pair of concave support portions opposed to each other in a direction of reciprocation of the each of the pistons, for slidably supporting respective shoes of the each of the pairs of shoes, wherein an amount of stroke of each of the pistons changes according to an inclination of the swash plate, which varies with pressure within the crankcase.

The variable capacity swash plate compressor is characterized in that at least one of the front-side sliding surface and the rear-side sliding surface of the swash plate has a mounting recess formed at an outer peripheral portion thereof, the outer peripheral portion receiving no load which acts on the at least one of the front-side sliding surface and the rear-side sliding surface of the swash plate, the mounting recess being used for assembling the each pair of the pairs of shoes with the swash plate and the pair of concave support portions at the one end of a corresponding one of the pistons, the mounting recess having a recess for placing one shoe of the each pair of the pairs of shoes therein and a guide face for guiding the one shoe onto a corresponding one of the at least one of the front-side sliding surface and the rear-side sliding surface of the swash plate.

In the variable capacity swash plate compressor of the invention, the mounting recess is formed in the outer peripheral portion of the at least one of the sliding surfaces as described above. Therefore, the swash plate, the shoes, and the piston can be easily assembled, according to the following procedure: First, one of the shoes is placed in the mounting recess of the swash plate. Next, the other shoe is fitted in one of the concave support portions at the one end of the piston. Then, the piston is moved horizontally for preliminary assembly with the swash plate. After the preliminary assembly, the piston is slid together with the shoes along the circumference of the swash plate. During this process, the shoe placed in the mounting recess is guided along the guide face onto the sliding surface of the swash plate, and then moved to a predetermined position to be fitted in the other concave support portion at the one end of the piston. Thus, the piston is assembled with the swash plate via the shoes. This makes it easy to assemble shoes and pistons with the swash plate manually, and makes it also possible to facilitate automatic assembly of the shoes and the pistons with the swash plate.

Preferably, the mounting recess is formed at the outer peripheral portion of the rear-side sliding surface of the swash plate at a location away from a top dead center position portion of the swash plate through approximately 90 degrees about a rotation axis of the swash plate in a direction of a suction stroke.

According to this preferred embodiment, the location of the mounting recess circumferentially away from the top dead center position portion of the swash plate through approximately 90 degrees about the rotation axis of the same in the direction of the suction stroke (i.e. in the direction of a suction stroke-effecting part of the swash plate by which each piston is driven for the suction stroke) corresponds to a portion of the swash plate which does not receive compressive load which acts on the rear-side sliding surface of the swash plate. Therefore, the compressing function of the compressor is not adversely affected.

Alternatively, the mounting recess is formed at the outer peripheral portion of the front-side sliding surface of the swash plate at a location away from a bottom dead center position portion of the swash plate through approximately 90 degrees about a rotation axis of the swash plate in a direction of a compression stroke.

According to this preferred embodiment, the location of the mounting recess circumferentially away from the top dead center position portion of the swash plate through approximately 90 degrees about the rotation axis of the same in the direction of the compression stroke (i.e. in the direction of a compression stroke-effecting part of the swash plate by which each piston is driven for the compression stroke) corresponds to a portion of the swash plate which does not receive tensile load which acts on the front-side sliding surface of the swash plate. Therefore, the suctioning function of the compressor is not adversely affected.

Alternatively, the mounting recess is formed at the outer peripheral portion of the rear-side sliding surface of the swash plate at a location away from a top dead center position portion of the swash plate through approximately 90 degrees about a rotation axis of the swash plate in a direction of a suction stroke, and at the outer peripheral portion of the front-side sliding surface of the swash plate at a location away from a bottom dead center position portion of the swash plate through approximately 90 degrees about a rotation axis of the swash plate in a direction of a compression stroke.

According to this preferred embodiment, the advantageous effects obtained by the above preferred embodiments can be also obtained.

Still preferably, the mounting recess is located radially outward of a locus of a center of the each pair of the pairs of shoes on the swash plate.

According to this preferred embodiment, the center of each pair of shoes is always on the locus thereof located radially inward of the mounting recess. Therefore, even if a radially outward force may act on any of the shoes, which can be generated by some cause, e.g. when the compressor is stopped, there is no fear of the shoe falling off the swash plate, and further each shoe is prevented from being caught by the mounting recess during operation of the compressor, whereby it is possible to prevent breakage of the compressor due to improper assemblage of the shoes with the piston and the swash plate.

The above and other objects, features and advantages of the present invention will become more apparent from the following detailed description taken in conjunction with accompanying drawings.

DETAILED DESCRIPTION OF THE PREFERRED EMBODIMENT

The invention will now be described in detail with reference to drawings showing a preferred embodiment thereof.

Figure 4:
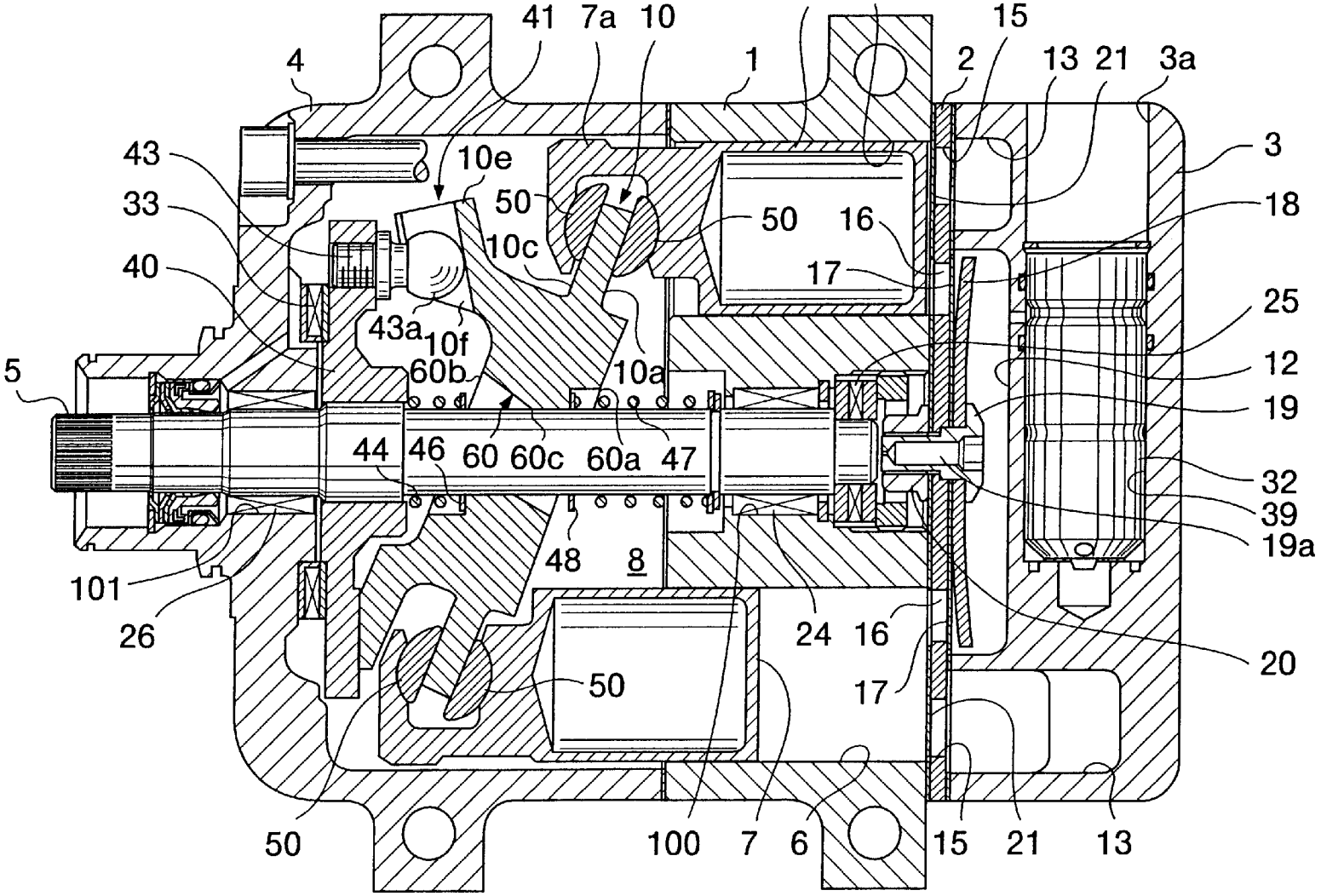
FIG. 4 is a longitudinal cross-sectional view showing the whole arrangement of the variable capacity swash plate compressor according to the embodiment.

Referring first to FIG. 4, there is shown the whole arrangement of a variable capacity swash plate compressor according to an embodiment of the invention.

The variable capacity swash plate compressor has a cylinder block 1 having one end thereof secured to a rear head 3 via a valve plate 2 and the other end thereof secured to a front head 4. The cylinder block 1 has a plurality of cylinder bores 6 axially extending therethrough at predetermined circumferential intervals about a drive shaft 5. Each cylinder bore 6 has a piston 7 slidably received therein.

Within the front head 4, there is formed a crankcase 8. The crankcase 8 has a swash plate 10 received therein. The swash plate 10 is slidably and tiltably fitted on the drive shaft 5. The swash plate 10 has a central hole 60 formed through a central portion thereof and having a substantially point-symmetrical shape with respect to the center of the swash plate 10. More specifically, openings 60*a*, 60*b* of the central hole 60 at opposite ends thereof each have a substantially elliptical shape. The distance between the rotation axis of the swash plate and an inner wall of the central hole 60 along the major axis of the substantially elliptical shape of the openings 60*a*, 60*b* is smallest at an intermediate portion 60*a* of the central hole 60, and is increased as the measured point shifts from the intermediate portion 60*c* to the opening 60*a* or 60*b*. The openings 60*a*, 60*b* each have linear portions along the minor axis of the substantially elliptical shape, which are parallel with each other and inhibit the swash plate 10 from moving sideways, i.e. in the direction of the minor axis of the substantially elliptical shape.

The piston 7 is connected to the swash plate 10 via a pair of hemispherical shoes 50. The shoes 50 are held at one end portion 7*a* of the piston 7 such that they can perform relative rotation on a front-side sliding surface 10*c* of the swash plate 10 and a rear-side surface 10*a* of the same, respectively, with respect to the circumference of the swash plate 10.

Within the rear head 3, there are formed a discharge chamber 12 and a suction chamber 13 surrounding the discharge chamber 12. Further, the rear head 3 is formed with a suction port 3*a* communicating between a refrigerant outlet port, not shown, of an evaporator, not shown, and a communication passage 39 for communication between the suction port 3*a* and the suction chamber 13. A pressure control valve 32 is provided at an intermediate portion of the communication passage 39 for controlling pressure within the suction chamber 13 and pressure within the crankcase 8.

The valve plate 2 is formed with refrigerant outlet ports 16 for respectively connecting the cylinder bores 6 with the discharge chamber 12 and refrigerant inlet ports 15 for respectively connecting the cylinder bores 6 with the suction chamber 13. The refrigerant outlet ports 16 and the refrigerant inlet ports 15 are arranged at predetermined circumferential intervals, respectively, about the drive shaft 5. Each refrigerant outlet port 16 is opened and closed by a discharge valve 17. The discharge valve 17 is fixed to a rear head-side end face of the valve plate 2 by a bolt 19 and nut 20 together with a valve stopper 18.

On the other hand, each refrigerant inlet port 15 is opened and closed by a suction valve 21 arranged between the valve plate 2 and the cylinder block 1. The bolt 19 has a guide hole 19*a* for guiding high-pressure refrigerant gas from the discharge chamber 12 to a radial bearing 24 and a thrust bearing 25.

The radial bearing 24 and the thrust bearing 25 are arranged in a central hole 100 formed through the cylinder block 1, for rotatably supporting a rear-side end of the drive shaft 5, while a radial bearing 26 is arranged in a through hole 101 formed,through the front head 4, for rotatably supporting a front-side end of the drive shaft 5.

The drive shaft 5 has a thrust flange (rotating member) 40 rigidly fitted on a front-side portion thereof, for transmitting torque of the drive shaft 5 to the swash plate 10. The thrust flange 40 is rotatably supported on an inner wall of the front head 4 by a thrust bearing 33 arranged between thrust flange 40 and the inner wall of the front head 4. The thrust flange 40 and the swash plate 10 are connected with each other via a linkage 41. The swash plate 10 can tilt with respect to a plane perpendicular to the drive shaft 5.

On the drive shaft 5 is fitted a coil spring 44 between the thrust flange 40 and the swash plate 10 to urge the swash plate 10 in a direction for decreasing the inclination of the swash plate 10, while a coil spring 47 is fitted on the drive shaft 5 between the swash plate 10 and the cylinder block 1 to urge the swash plate 10 in a direction for increasing the inclination of the swash plate 10. A washer 46 receiving the coil spring 44 is engaged with the opening 60*b* of the central hole 60, and a washer 48 receiving the coil spring 47 with the opening 60*a* of the same. The outer diameter of the washer 46(48) is larger than the length of the minor axis of the substantially elliptical shape of the opening 60*a*(60*b*).

The linkage 41 is comprised of a bracket 10*e* formed on a front-side surface of the swash plate 10, a linear guide groove 10*f* formed in the bracket 10*e*, and a rod 43 screwed into the thrust flange 40. The longitudinal axis of the guide groove 10*f* is inclined at a predetermined angle with respect to the sliding surfaces 10*a*, 10*c* of the swash plate 10. The rod 43 has a spherical end portion 43*a* thereof slidably fitted in the guide groove 10*f*.

Figure 1:
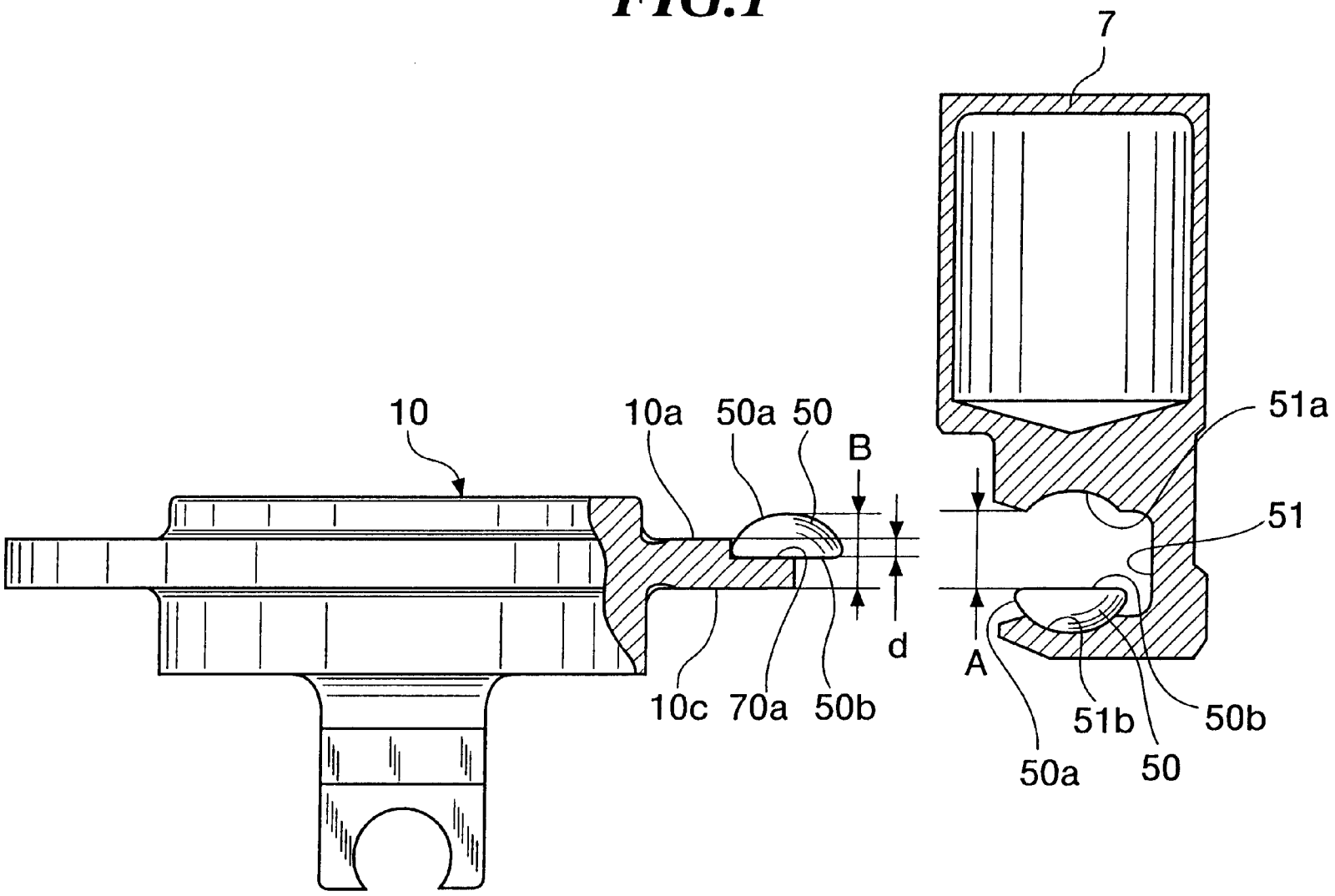
FIG. 1 is an exploded side view, partly in section, showing a piston, shoes, and a swash plate of a variable capacity swash plate compressor according to an embodiment of the invention.
Figure 2:
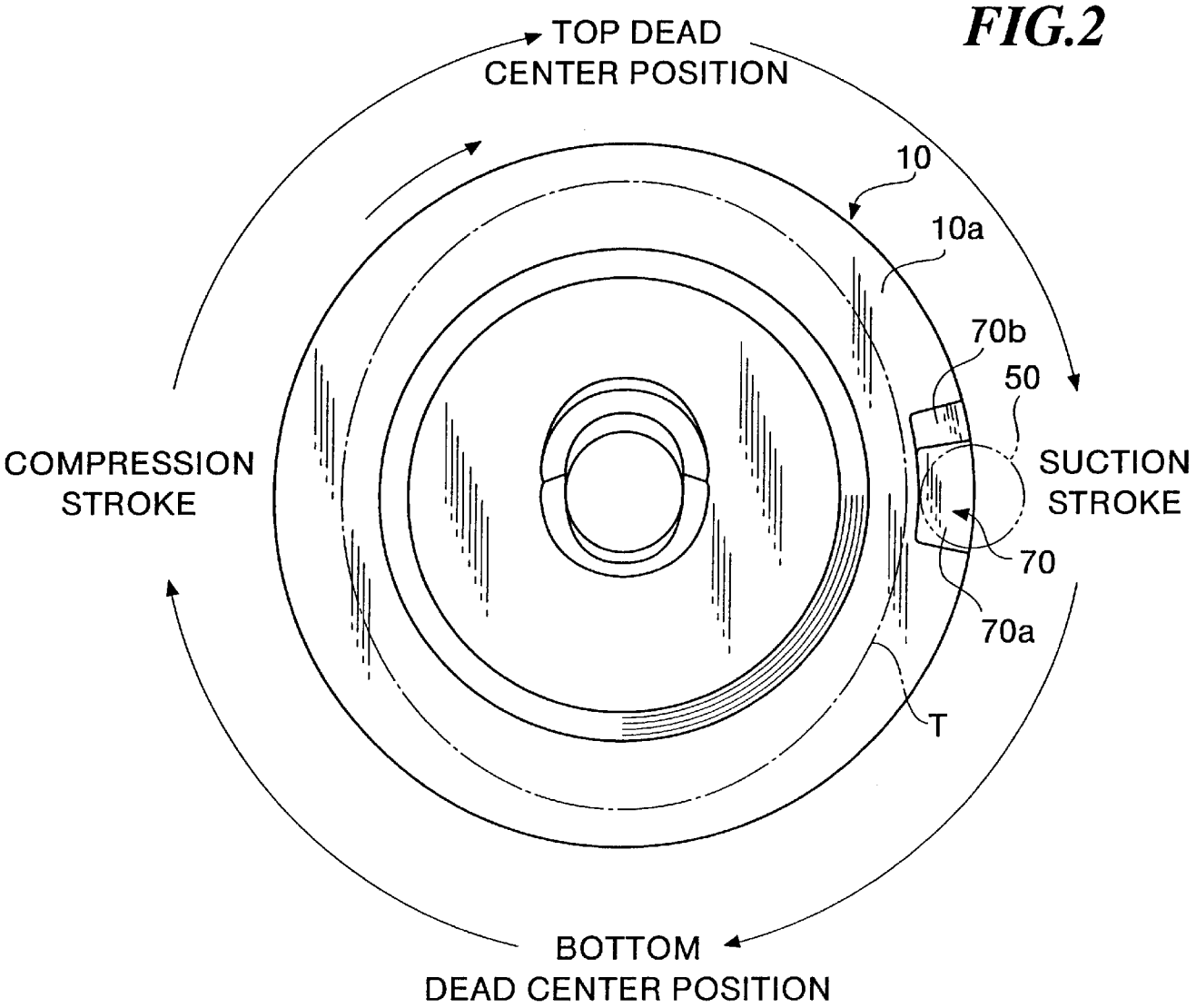
FIG. 2 is a plan view showing a rear-side sliding surface of the swash plate appearing in FIG. 1.

FIG. 1 shows the piston 7, the shoes 50, 50, and the swash plate 10 of the variable capacity swash plate compressor according to the embodiment of the invention, in an exploded state. FIG. 2 is a plan view showing the rear-side sliding surface 10*a* of the swash plate 10, and FIG. 3 shows the piston 7, the shoes 50, 50, and the swash plate 10, in the course of assembly as well as in an assembled state.

Figure 3:
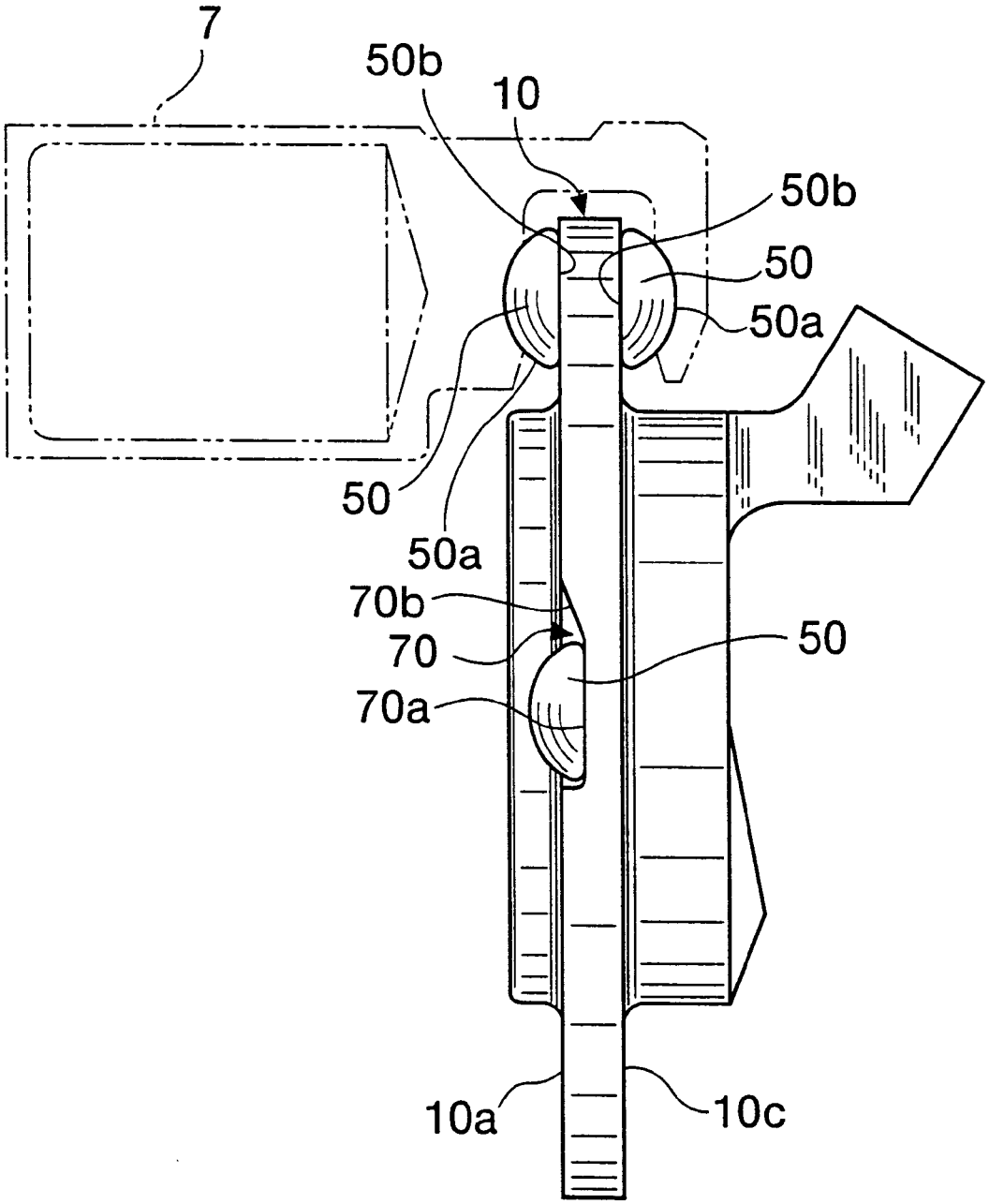
FIG. 3 is a side view showing the piston, the shoes, and the swash plate in the course of assembly as well as in an assembled state.

Referring to FIG. 3, the shoes 50, 50 are arranged in a manner sandwiching the swash plate 10, and flat portions 50*b*, 50*b* of the shoes 50, 50 are in contact with the sliding surfaces 10*a*, 10*c*, respectively.

Referring to FIG. 1, the piston 7 has the one end portion 7*a* formed therein with a recess 51 in which is received an outer peripheral portion of the swash plate 10. The recess 51 has concave portions (concave support portions) 51*a*, 51*b* formed therein in a manner opposed to each other in a direction of reciprocation of the piston 7. Convex portions 50*a*, 50*a* of the shoes 50, 50 are slidably fitted in and supported by the concave portions 51*a*, 51*b*, respectively. The convex portions 50*a*, 50*a* of the shoes 50, 50 have an identical radius of curvature, and are shaped to form respective portions of an imaginary sphere.

Now, referring to FIG. 2, the rear-side sliding surface 10*a* of the swash plate 10 has a recess 70 formed at an outer peripheral portion thereof, for use in mounting one shoe of each pair of shoes 50 in the piston 7 to thereby assemble the pair of shoes 50 and the piston 7 with the swash plate 10. The mounting recess 70 is located at a portion of the rear-side sliding surface 10*a* of the swash plate 10 circumferentially away from a top dead center position portion of the swash plate 10 through approximately 90 degrees about the rotation axis of the same in the direction (clockwise direction as viewed in FIG. 2) of the suction stroke of the swash plate 10, i.e. in the direction of a suction stroke-effecting part of the swash plate by which each piston is driven for the suction stroke. The portion of rear-side sliding surface 10*a* of the swash plate 10 located circumferentially away from the top dead center position portion of the swash plate through approximately 90 degrees about the rotation axis of the swash plate 10 in the direction of the suction stroke is a portion which does not receive compressive load which acts on the rear-side sliding surface 10*a* of the swash plate 10.

The mounting recess 70 includes a recess 70*a* for placing a shoe 50 therein and a tapered face (guide face) 70*b* for guiding the shoe 50 onto the sliding surface 10*a*, as best shown in FIG. 3. The recess 70*a* has a bottom parallel to the sliding surface 10*a*, while the tapered face 70*b* forms a slope gently ascending from an end of the recess 70*a* to the sliding surface 10*a*. The tapered face 70*b* is located backward of the recess 70*a* with respect to the direction of rotation of the swash plate 10.

As shown in FIG. 1, a depth d of the recess 70*a* is set such that a dimension A (amount of clearance of an opening for mounting the shoe 50 in the piston 7) is larger than a dimension B (sum of a thickness of the portion of the swash plate 10 at which the mounting recess 70 is formed and a thickness of the shoe 50)(i.e. A>B holds).

The mounting recesses 70 is located radially outward of a locus T of the center of the shoe 50 (i.e. the center of the pair of shoes 50, 50) on the swash plate. A radial width of the mounting recess 70 Is larger than a radius of the flat portion 50*b* of the shoe 50.

Next, a procedure of assembly of the piston 7, the shoes 50, and the swash plate 10 will be described with reference to FIG. 1.

First, one of the shoes 50 is placed in the mounting recess 70 of the swash plate 10.

Next, the other shoe 50 is placed in the concave portion 51*b* of the piston 7.

Then, the piston 7 is shifted horizontally to the left as viewed in FIG. 1, whereby the piston 10 and shoes are preliminary assembled with the swash plate 10.

After effecting the preliminary assembly, the piston 7 is slid along the circumference of the swash plate 10. During the process, the shoe 50 to be properly fitted in the concave portion 51*a* of the piston 7 is guided along the tapered face 70*b* onto the sliding surface 10*a* of the swash plate 10, and then moved to a predetermined position on the locus T of the center of the shoes 50 on the swash plate 10 shown in FIG. 2 relative to positions of other shoes on the same with a radial inward shift of its position, where the shoe 50 is properly fitted in the concave portion 51a (see FIG. 3) at the same time.

The other pistons 7 are assembled with the swash plate 10, one after another, according to the same procedure.

Next, the operation of the variable capacity swash plate compressor constructed as above will be described.

Torque of an engine, not shown, installed on an automotive vehicle, not shown, is transmitted to the drive shaft 5 to rotate the same. Torque of the drive shaft 5 is transmitted to the swash plate 10 via the thrust flange 40 and the linkage 41 to cause rotation of the swash plate 10.

The rotation of the swash plate 10 causes relative rotation of the shoes 50, 50 on the sliding surfaces 10*a*, 10*c* of the swash plate 10 with respect to the circumference of the swash plate 10, whereby the torque transmitted from the swash plate 10 is converted into reciprocating motion of the piston 7. As the piston 7 reciprocates within the cylinder bore 6, the volume of compression chambers within the cylinder bore 6 changes. As a result, suction, compression and delivery of refrigerant gas are sequentially carried out in each compression chamber, whereby high-pressure refrigerant gas is delivered from the compression chamber in an amount corresponding to an inclination of the swash plate 10. During the suction stroke, the suction valve 21 opens to draw low-pressure refrigerant gas from the suction chamber 13 into the compression chamber within the cylinder bore 6. During the discharge stroke, the discharge valve 17 opens to deliver high-pressure refrigerant gas from the compression chamber to the discharge chamber 12.

During the operation of the compressor, compressive load is not imposed on the mounting recess 70, so that abrasion or so-called dragging does not occur.

When thermal load on the compressor decreases, the pressure control valve 32 closes the communication passage, whereby pressure within the crankcase 8 is increased to decrease the inclination of the swash plate 10. As a result, the stroke of the piston 7 is decreased to reduce the delivery quantity or capacity of the compressor.

On the other hand, when the thermal load on the compressor increases, the pressure control valve 32 opens the communication passage, whereby the pressure within the crankcase 8 is lowered to increase the inclination of the swash plate 10. As a result, the stroke of the piston 7 is increased to increase the delivery quantity or capacity of the compressor.

According to the variable capacity swash plate compressor of the embodiment, the rear-side sliding surface 10*a* of the swash plate 10 has the mounting recess 70 formed therein at the location circumferentially away from the top dead center position portion of the swash plate 10 through approximately 90 degrees about the rotation axis of the same in the direction of the suction stroke (in the direction of the suction stroke-effecting part of the swash plate), which makes it easy to assemble the shoes 50 and the piston 7 with the swash plate 10 manually irrespective of the thickness of the shoe 50 and the number of pistons to be assembled, and makes it also possible to facilitate automatic assembly of the shoes 50 and the piston 7 with the swash plate 10.

Further, when the assembly is completed, the shoe 50 is set such that the center thereof is positioned on the locus T shown in FIG. 2, so that the center of the shoe is always on the locus located radially inward of the mounting recess 70, and hence even if radially outward force may act on any of the shoes, which can be generated by some cause, e.g. when the compressor is stopped, there is no fear of the shoe falling off the swash plate, and further each shoe is prevented from being caught by the mounting recess during operation of the compressor, whereby it is possible to prevent breakage of the compressor due to improper assemblage of the shoes with the piston and the swash plate.

Figure 5:
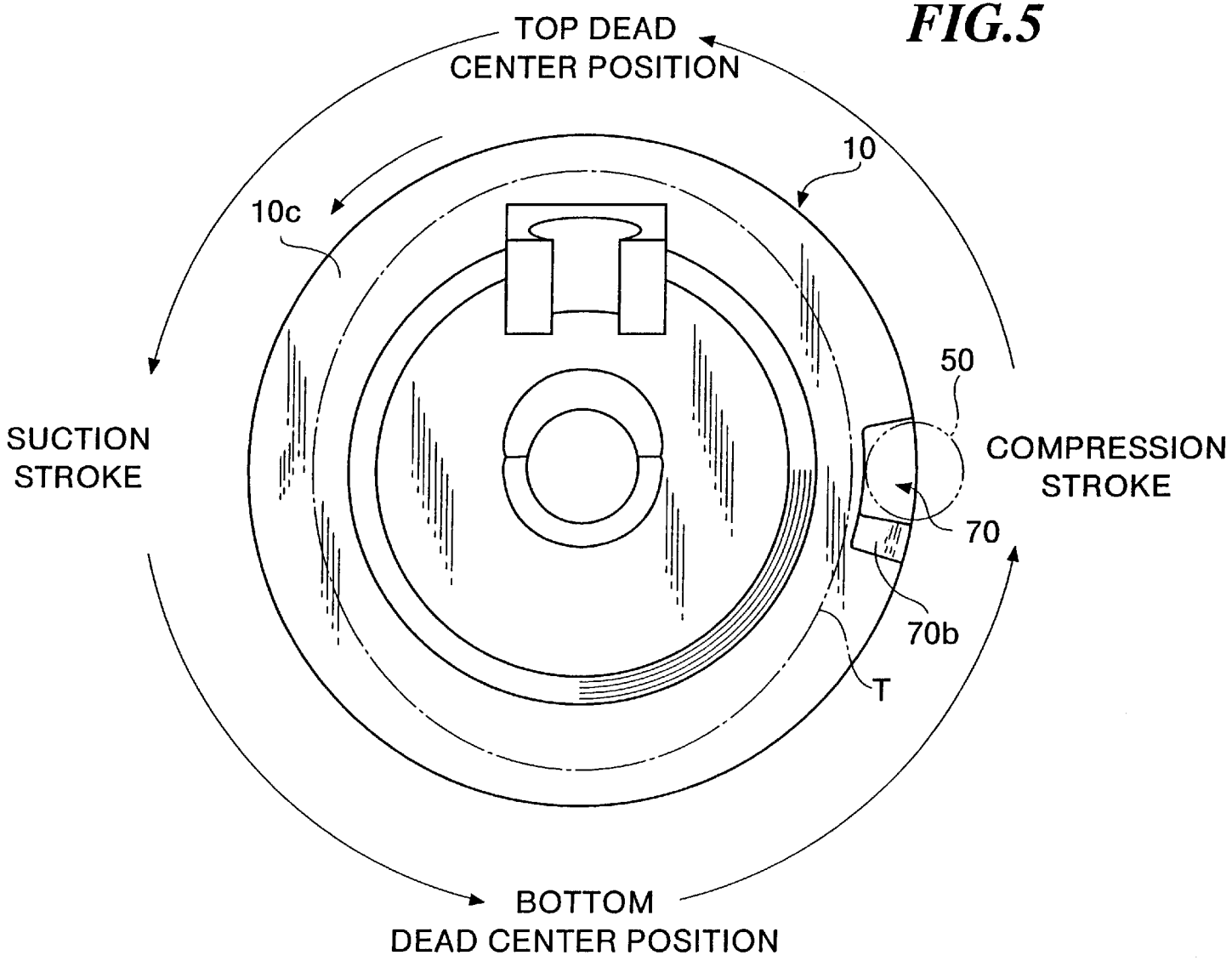
FIG. 5 is a plan view showing a variation of the embodiment.

Although in the above embodiment, the mounting recess 70 is formed in the rear-side sliding surface 10*a* of the swash plate 10, this is not limitative, but as shown in FIG.5, the mounting recess 70 may be formed in the front-side sliding surface 10*c* of the swash plate 10 at a location circumferentially away from a bottom dead center position portion of the swash plate 10 through approximately 90 degrees about the rotation axis of the same in the direction of the compression stroke, i.e. in the direction of a compression stroke-effecting part of the swash plate by which each piston is driven for the suction stroke. The portion of the front-side sliding surface 10*c* of the swash plate 10 located circumferentially away from the bottom dead center position portion of the swash plate through approximately 90 degrees about the rotation axis of the same in the direction of the compression stroke is a portion which does not receive tensile load which acts on the front-side sliding surface 10*c* of the swash plate 10.

Figure 6:
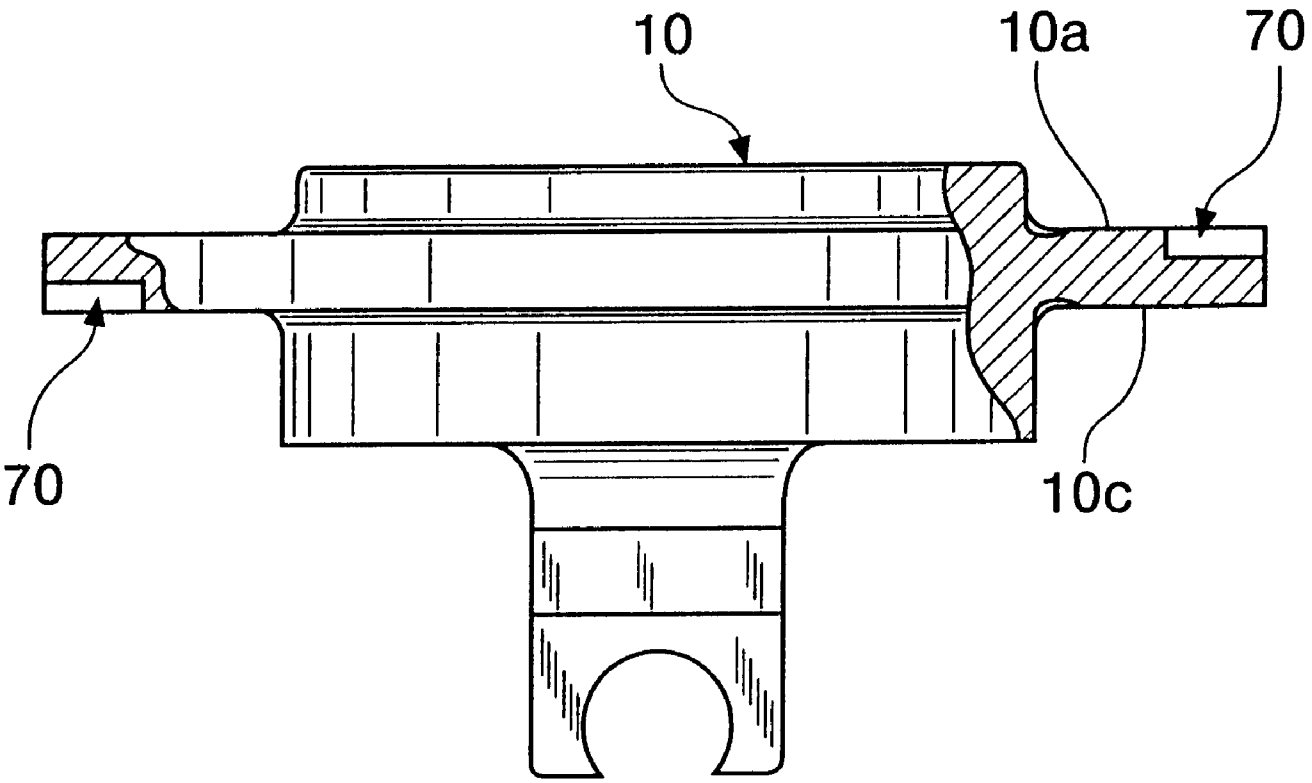
FIG. 6 is a side view, partly in section, of the swash plate according to another variation of the embodiment.

FIG. 6 shows a further variation of the embodiment, in which the mounting recess is provided in the rear-side sliding surface 10*a* of the swash plate 10 at the location circumferentially away from the top dead center position portion of the swash plate 10 through approximately 90 degrees about the rotation axis of the same in the direction of the suction stroke, and also in the front-side sliding surface 10*a* of the swash plate 10 at the location circumferentially away from the bottom dead center position portion of the swash plate 10 through approximately 90 degrees about the rotation axis of the same in the direction of the compression stroke.

This variation provides the same effects as obtained by the above embodiment.

It is further understood by those skilled in the art that the foregoing is the preferred embodiment and variations of the invention, and that various changes and modifications may be made without departing from the spirit and scope thereof.

What is claimed is:

1. In a variable capacity swash plate compressor including a drive shaft having one end, a rotating member rigidly fitted on said drive shaft, for rotation in unison with said drive shaft, a swash plate which is tiltably and rotatably mounted on said drive shaft, said swash plate having a front-side sliding surface and a rear-side sliding surface, a linkage connecting said rotating member and said swash plate in a manner such that said swash plate rotates in unison with said rotating member as said rotating member rotates, a crankcase through which said drive shaft extends and in which said swash plate is received, pairs of shoes each having a substantially hemispherical shape, each pair of said pairs of shoes performing relative rotation on said front-side sliding surface and said rear-side sliding surface of said swash plate, respectively, with respect to a circumference of said swash plate as said swash plate rotates, a cylinder formed therethrough with a plurality of cylinder bores and a central hole, said one end of said drive shaft being rotatably arranged in said central hole, and a plurality of pistons each connected to said swash plate via a corresponding pair of said pairs of shoes and reciprocating within a corresponding one of said cylinder bores as said swash plate rotates, said each pair of said pairs of shoes being arranged on said front-side sliding surface and said rear-side sliding surface, respectively, in a manner sandwiching said swash plate, each of said pistons having one end thereof formed therein with a pair of concave support portions opposed to each other in a direction of reciprocation of said each of said pistons, for slidably supporting respective shoes of said each of said pairs of shoes, wherein an amount of stroke of each of said pistons changes according to an inclination of said swash plate, which varies with pressure within said crankcase, the improvement wherein at least one of said front-side sliding surface and said rear-side sliding surface of said swash plate has a mounting recess formed at an outer peripheral portion thereof, said outer peripheral portion receiving no load which acts on said at least one of said front-side sliding surface and said rear-side sliding surface of said swash plate, said mounting recess being used for assembling said each pair of said pairs of shoes with said swash plate and said pair of concave support portions at said one end of a corresponding one of said pistons, said mounting recess having a recess for placing one shoe of said each pair of said pairs of shoes therein and a guide face for guiding said one shoe onto a corresponding one of said at least one of said front-slde sliding surface and said rear-side sliding surface of said swash plate.

2. A variable capacity swash plate compressor according to claim 1, wherein said mounting recess is formed at said outer peripheral portion of said rear-side sliding surface of said swash plate at a location away from a top dead center position portion of said swash plate through approximately 90 degrees about a rotation axis of said swash plate in a direction of a suction stroke.

3. A variable capacity swash plate compressor according to claim 1, wherein said mounting recess is formed at said outer peripheral portion of said front-side sliding surface of said swash plate at a location away from a bottom dead center position portion of said swash plate through approximately 90 degrees about a rotation axis of said swash plate in a direction of a compression stroke.

4. A variable capacity swash plate compressor according to claim 1, wherein said mounting recess is formed at said outer peripheral portion of said rear-side sliding surface of said swash plate at a location away from a top dead center position portion of said swash plate through approximately 90 degrees about a rotation axis of said swash plate in a direction of a suction stroke, and at said outer peripheral portion of said front-side sliding surface of said swash plate at a location away from a bottom dead center position portion of said swash plate through approximately 90 degrees about a rotation axis of said swash plate in a direction of a compression stroke.

5. A variable capacity swash plate compressor according to claim 1, wherein said mounting recess is located radially outward of a locus of a center of said each pair of said pairs of shoes on said swash plate.

6. A variable capacity swash plate compressor according to claim 2, wherein said mounting recess is located radially outward of a locus of a center of said each pair said pairs of shoes on said swash plate.

7. A variable capacity swash plate compressor according to claim 3, wherein said mounting recess is located radially outward of a locus of a center of said each pair of said pairs of shoes on said swash plate.

8. A variable capacity swash plate compressor according to claim 4, wherein said mounting recess is located radially outward of a locus of a center of said each pair of said pairs of shoes on said swash plate.

* * * * *